US005467891A

United States Patent [19]

Perry

[11] Patent Number: 5,467,891

[45] Date of Patent: Nov. 21, 1995

[54] BEVERAGE CONTAINER INSULATOR

[75] Inventor: Michael L. Perry, Wichita Falls, Tex.

[73] Assignee: Robert S. Scheurer, Wichita Falls, Tex.

[21] Appl. No.: 421,397

[22] Filed: Apr. 13, 1995

[51] Int. Cl.[6] ..... B65D 23/08

[52] U.S. Cl. ..... 220/739; 220/413; 220/903

[58] Field of Search ..... 220/903, 739, 220/737, 408, 410, 402, 400, 412, 413

[56] References Cited

U.S. PATENT DOCUMENTS

| | | | |
|---|---|---|---|
| 4,163,374 | 8/1979 | Moore et al. | 220/903 |
| 4,372,453 | 2/1983 | Branscum | 220/903 |
| 4,383,422 | 5/1983 | Gordon et al. | 220/903 |
| 4,462,444 | 7/1984 | Larson | 220/903 |
| 4,510,665 | 4/1985 | Scheurer . | |
| 4,811,858 | 3/1989 | Augus | 220/903 |
| 4,928,848 | 5/1990 | Ballway | 220/903 |

*Primary Examiner*—Stephen J. Castellano
*Attorney, Agent, or Firm*—Dennis T. Griggs

[57] ABSTRACT

A beverage container insulator has an outer, vinyl coated, flexible plastic foam sleeve member open at both ends and having inwardly curved ends with re-entrant edges. A substantially rigid cup-shaped plastic inner liner, shorter than the sleeve member, is disposed in the sleeve member with an interference fit between the liner and sleeve member. A top edge of the liner has a radially projecting flange to add rigidity and aid in retaining the liner within the sleeve member. The liner has a vacuum break opening in a transverse bottom wall to provide for ease of insertion, retention and removal of a beverage container with respect to the insulator.

9 Claims, 2 Drawing Sheets

BEVERAGE CONTAINER INSULATOR

FIELD OF THE INVENTION

The present invention relates to a beverage container insulator characterized by an outer vinyl coated, unicellular plastic foam sleeve and an inner substantially rigid liner providing improved support and ease of removal of a beverage can or bottle.

1. Background of the Invention

Plastic foam beverage container insulators are widely used to provide thermal insulation for beverage cans or bottles and to provide a comfortable covering for holding such a can or bottle by the consumer.

2. Description of the Prior Art

One example of an improved beverage container insulation sleeve is described in U.S. Pat. No. 4,510,665 issued Apr. 16, 1985 to Steven M. Scheurer and assigned to the assignee of the present invention. The '665 patent is directed to a unicellular foam sleeve disposed around a cylindrical disk-like base. A vacuum break opening is formed in a sidewall of the sleeve to facilitate easy removal of a beverage container from the sleeve.

However, one continuing problem in the development of plastic foam insulating sleeves for beverage containers pertains to the tendency for the relatively soft, flexible foam sleeve to cling to the container when it is desired to remove the container from the sleeve even though a suitable vacuum break may be provided such as described in the '665 patent. Accordingly, there has been a continuing need to improve beverage container insulation sleeves, particularly of the type which advantageously utilize relatively soft, flexible unicellular plastic foam for the primary insulating member. It is to this end that the present invention has been developed.

SUMMARY OF THE INVENTION

The present invention provides an improved beverage container insulator which remains secured to and sleeved around a beverage container but is also easily removed from the container when desired.

In accordance with an important aspect of the present invention, a beverage container insulator is provided having an outer sleeve member of relatively soft, resilient, flexible unicellular foam plastic in which a somewhat rigid plastic liner is disposed and adapted to receive a beverage container such as a generally cylindrical can or bottle.

In accordance with another important aspect of the invention, a beverage container insulator is provided having a generally cylindrical cup-shaped liner which is of a diameter slightly larger than the relaxed diameter of the resilient sleeve member and is shorter in overall length than the sleeve member. Accordingly, a moderate interference fit between the sleeve member and the liner prevents unwanted displacement of the liner from the sleeve and the opposite ends of the sleeve curve over the ends of the liner and inwardly to form reentrant top and bottom edges of the sleeve.

The inwardly curved top edge of the sleeve member advantageously forms a gasket or seal around a beverage container disposed in the insulator to improve the insulating characteristics of the beverage insulator. Moreover, the inwardly curved bottom edge of the sleeve supports the insulator on a table surface or the like and prevents contact of the liner bottom wall with the support surface thereby substantially eliminating condensation rings on a table surface and giving the insulator a soft feel when it is set on a surface.

In accordance with yet a further aspect of the present invention, the substantially rigid inner liner of the sleeve has a circumferential outwardly projecting flange adjacent its open end which adds rigidity to the liner, aids in retaining the liner within the sleeve member and also promotes the formation of a re-entrant top edge of the resilient sleeve member. The top edge of the sleeve member is thus not only engageable with a beverage container to minimize circulation of air between the liner and the container but prevents unwanted spillage of any condensed water vapor which may accumulate on that portion of the outer surface of a cold beverage container disposed in the liner.

Still further, the insulator of the present invention advantageously includes a somewhat rigid plastic liner having a cylindrical shape which may be slightly tapered to aid in firmly engaging a beverage container but also permitting relatively easy removal of the container from the sleeve, at will.

Still further advantages of the invention reside in the provision of an insulator having a liner which is larger in diameter and slightly shorter than an outer, resilient and flexible insulating sleeve member whereby the liner is substantially encapsulated by the sleeve to prevent contact of the liner with a surface on which the insulator is set. Moreover, the insulating sleeve member is advantageously provided with a protective plastic coating, such as vinyl, disposed on the sleeve surfaces to enhance the strength, durability and tear resistance of the sleeve member and to improve the appearance of the insulator.

Further advantages and superior features of the invention will be recognized by those skilled in the art upon reading the detailed description which follows in conjunction with the drawing.

DESCRIPTION OF A PREFERRED EMBODIMENT

Figure 1:
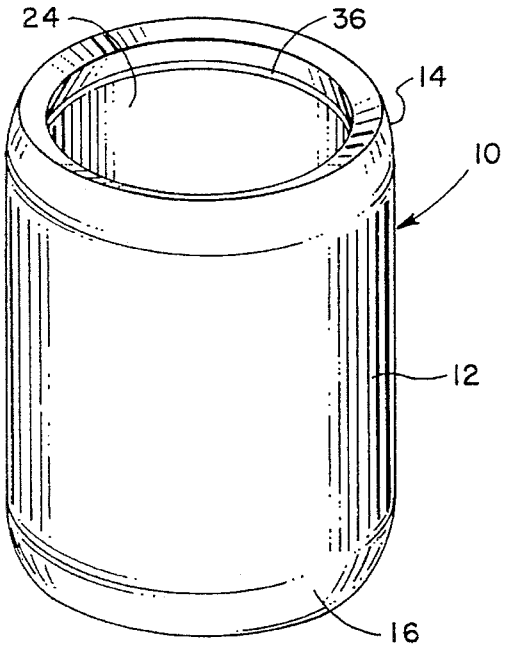
FIG. 1 is a perspective view of the beverage container insulator of the present invention.
Figure 2:
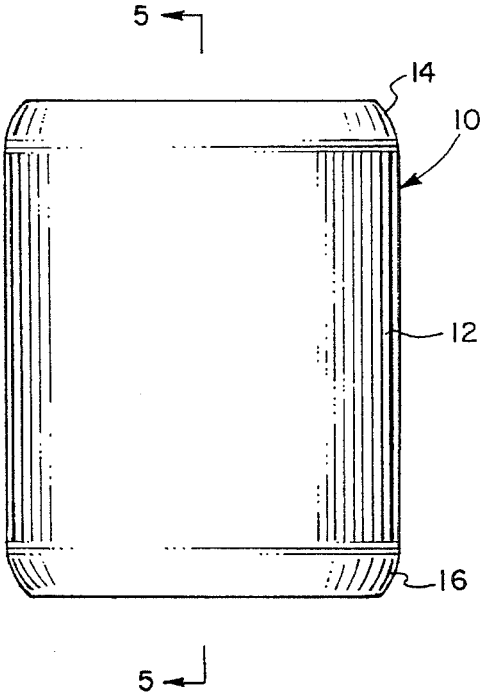
FIG. 2 is a side elevation of the insulator.
Figure 3:
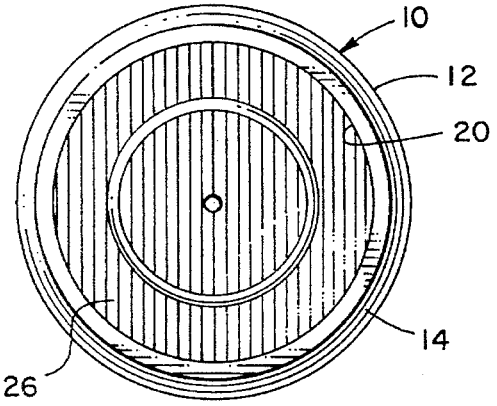
FIG. 3 is a top plan view of the insulator.
Figure 4:
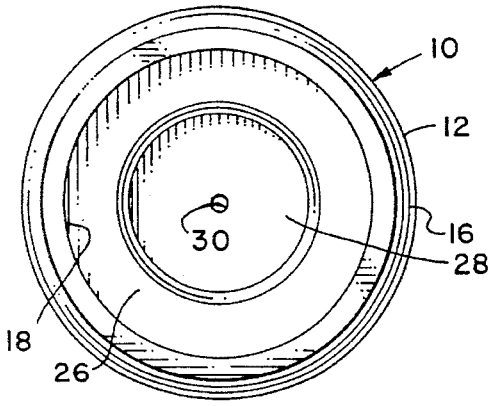
FIG. 4 is a bottom plan view of the insulator.

Referring to the drawing, FIGS. 1 through 5, in particular, there is illustrated a unique beverage container insulator in accordance with the invention and generally designated by the numeral 10. The insulator 10 has an outer, generally cylindrical sleeve member 12, FIG. 5, having inwardly curved opposed ends 14 and 16 and an inwardly projecting circumferential lip 18 delimiting a bottom opening of the sleeve member. In a similar manner an inwardly projecting or re-entrant circumferential edge 20 is formed inside the circumferential curved top end of the sleeve member 12 and delimiting a somewhat frusto conical surface 21. The sleeve member 12 is preferably formed of a suitable unicellular, resilient, flexible, plastic foam material such as polyurethane. A vinyl coating 22 is preferably disposed over all exposed surfaces of the sleeve member 12. The vinyl coating 22 provides a tear resistant and strength and durability enhancing feature of the foam sleeve member 12 which also facilitates the adherence of decorative indicia on the outer sidewall surface of the insulator.

Figure 5:
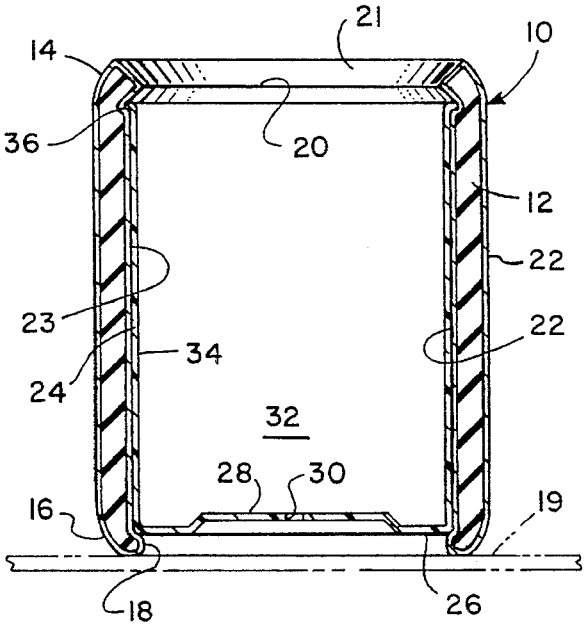
FIG. 5 is a central section view taken substantially along the line 5—5 of FIG. 2.
Figure 6:
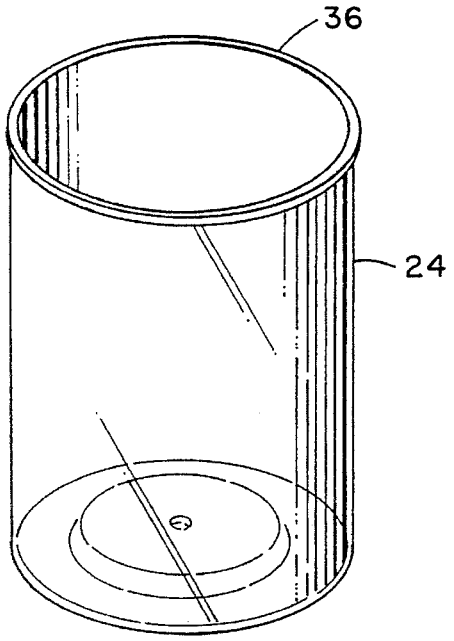
FIG. 6 is a top perspective view of the insulator liner.
Figure 7:
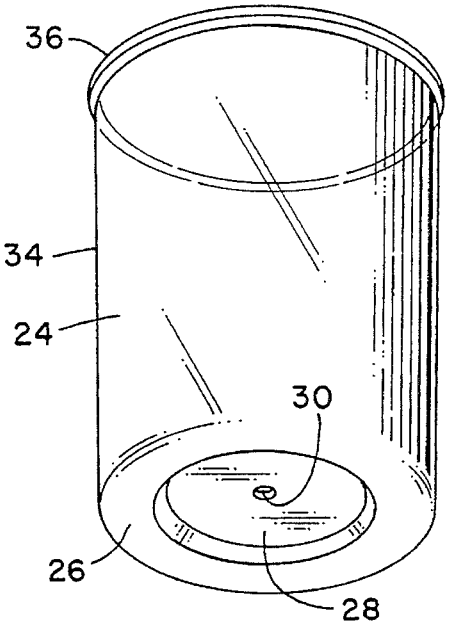
FIG. 7 is a bottom perspective view of the liner.

Referring to FIGS. 5 through 7, and particularly FIG. 5, the insulator 10 is advantageously provided with an inner, generally cylindrical, cup-shaped liner 24 which is disposed entirely within the sleeve member 12. The liner 24 has a transverse bottom wall 26 with a stand-off circular recessed surface 28 and a vacuum break opening 30 formed centrally in the surface 28 to minimize creation of a vacuum within the interior space 32 of the liner when a beverage can or bottle is disposed therein. The liner 24 includes a cylindrical sidewall 34 extending between the bottom wall 26 and a radially outwardly projecting circumferential flange 36 delimiting the top edge of the liner. The liner 24 is preferably formed of a suitable injection moldable, somewhat rigid plastic having a low coefficient of friction. The outwardly projecting flange 36 adds rigidity to the liner 24 and, due to the interference fit between the inside circumferential wall surface 23 of the sleeve member 12 and the outer surface of the sidewall 34, and the fact that the liner is shorter than the sleeve member, the flange tends to urge the re-entrant edge 20 of the sleeve member 12 radially inwardly.

As mentioned previously, the liner 24 preferably has a sidewall 34 which is slightly larger in diameter than the relaxed inside diameter of the sleeve member 12 so that a moderate interference fit is formed between the liner and the sleeve member. Moreover, since the liner 24 is of an overall length less than the overall length of the sleeve member 12, the liner is totally enclosed between the opposed curved ends 14 and 16 of the sleeve member. Thanks to the lip 18 and the flange 36, the liner 24 is also more firmly retained within the sleeve member 12. As shown in FIG. 5, the bottom end 16 and lip 18 of the sleeve member 12 support the insulator 10 on a planar support surface 19 such that the liner bottom wall 26 is stood off from the surface 19.

The interference fit between the liner 24 and the sleeve member 12 together with the fact that the sleeve member is longer than the liner provides the inwardly curved ends 14 and 16, respectively, together with the circumferential lip 18 and the circumferential edge 20. The lip 18 forms a soft surface on which the insulator may be set and holds the bottom wall 26 of the liner off of a table surface or the like to minimize heat transmission therebetween and, for example, accumulation of condensation or so-called condensation rings on the table surface. The circumferential edge 20 formed inside the top end 14 is engageable with a beverage container to form a seal which improves the insulating characteristics of the insulator 10 and prevents spillage of any condensation, which may have accumulated on the portion of the beverage container within the liner 24, when the container is tipped during consumption of a beverage.

Fabrication of the liner 24 and the sleeve member 12 may be carried out using conventional practice in the fabrication of plastic and plastic foam structures. The combination of the flexible, vinyl coated, resilient plastic foam sleeve member 12, with its superior thermal insulation properties, and the somewhat rigid, smooth walled liner member 24 provides an improved beverage container insulator which is easily handled, which provides easier insertion and removal of beverage containers than prior art insulators and which enjoys the advantages mentioned herein.

Figure 8:
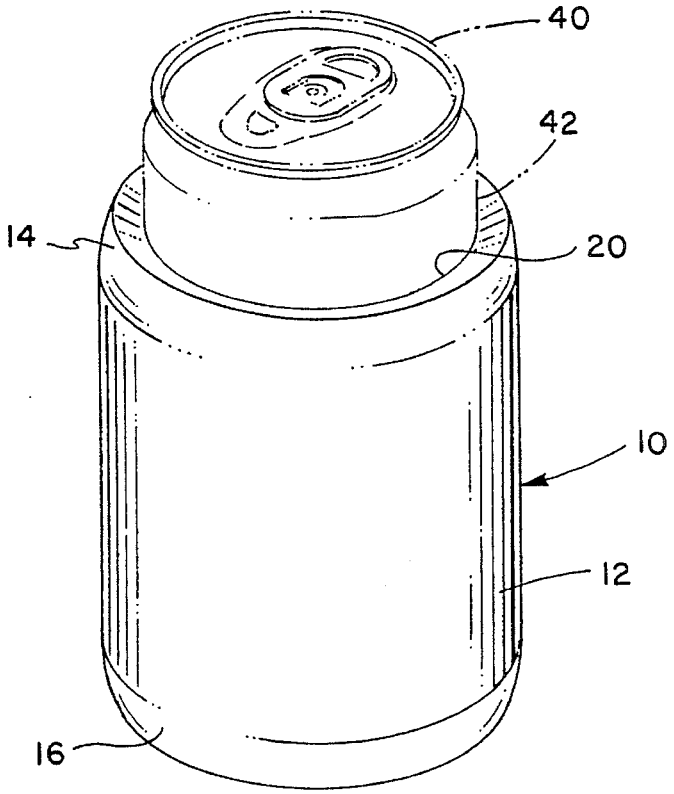
FIG. 8 is a perspective view of the insulator showing a conventional beverage can disposed therein.

FIG. 8 illustrates a conventional beverage can 40 disposed in the insulator 10 and showing the re-entrant edge 20 engaged with the outer sidewall surface 42 of the can to form a seal around the can to substantially prevent circulation of air between the liner sidewall 34 and the can. Moreover, the vacuum break opening 30 in the standoff surface 28 also minimizes any substantial resistance to removing the can 40 from the sleeve 10.

Although a preferred embodiment of the invention has been described in detail herein, those skilled in the art will recognize that certain modifications and substitutions may be made to the insulator of the invention without departing from the scope and spirit of the appended claims.

What is claimed is:

1. A beverage container insulator comprising:

a generally cylindrical outer sleeve member formed of a flexible, resilient insulating plastic foam and having an opening edge at least at one end of the sleeve member;

an inner liner disposed in the sleeve member and substantially retained in the sleeve member by an interference fit between at least part of the liner and the sleeve member, respectively, the sleeve member extending beyond opposed ends of the liner and having inwardly curved top and bottom ends, respectively; and, a coating layer of polymer plastic disposed on the sleeve member.

2. The beverage container insulator as set forth in claim 1 wherein:

the polymer plastic coating comprises vinyl.

3. The beverage container insulator as set forth in claim 1 including:

the liner having a peripheral outwardly projecting flange at the opening edge thereof engageable with an inside wall surface of the sleeve member.

4. The beverage container insulator as set forth in claim 1 wherein:

the liner includes a transverse bottom wall having an opening therein to minimize creation of a vacuum within the liner in response to removing a beverage container therefrom.

5. A beverage container insulator comprising:

a generally cylindrical sleeve member formed of flexible plastic foam and having vinyl coated surfaces thereof;

a substantially rigid plastic liner having a cylindrical sidewall dimensioned to be slightly larger than an inner sidewall of the sleeve member and being insertable in the sleeve member in an interference fit, the liner having a length less than the overall length of the sleeve member wherein the sleeve member extends beyond opposed ends of the liner and curves inwardly beyond the opposed ends of the liner, respectively.

6. The beverage container insulator as set forth in claim 5 wherein:

the liner has a transverse bottom wall having an opening therein to permit air to flow in and out of an interior space of the liner.

7. A beverage container insulator comprising:

a generally cylindrical, flexible, vinyl coated plastic foam sleeve member having opposed ends which include re-entrant top and bottom edges of the sleeve member;

a cup-shaped inner liner for the sleeve member having a generally cylindrical sidewall, a transverse bottom wall and an outwardly projecting flange at an end of the liner opposite the bottom wall to add rigidity to the sidewall of the liner, the liner having an outside diameter slightly greater than the inside diameter of the sleeve member to provide an interference fit of the liner when disposed within the sleeve member, the liner having an overall length less than the overall length of the sleeve member wherein the edges of the sleeve member extend over opposite ends of the liner, and the liner having an opening in the transverse bottom wall to provide a vacuum break between a beverage container and the liner.

8. The beverage container insulator as set forth in claim 7 wherein:

the top edge of the sleeve member extends radially inwardly of the sidewall of the liner and is engageable with a beverage container disposed in the liner to form a seal around the container.

9. The beverage container insulator as set forth in claim 7 wherein:

the bottom edge of the sleeve member forms a surface for setting the insulator on a planar support surface whereby the bottom wall of the liner is offset from the support surface.

* * * * *